US008214202B2

(12) United States Patent
Bruhn

(10) Patent No.: US 8,214,202 B2
(45) Date of Patent: Jul. 3, 2012

(54) METHODS AND ARRANGEMENTS FOR A SPEECH/AUDIO SENDER AND RECEIVER

(75) Inventor: Stefan Bruhn, Sollentuna (SE)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 697 days.

(21) Appl. No.: 12/441,259

(22) PCT Filed: Sep. 13, 2006

(86) PCT No.: PCT/EP2006/066324
§ 371 (c)(1),
(2), (4) Date: Mar. 13, 2009

(87) PCT Pub. No.: WO2008/031458
PCT Pub. Date: Mar. 20, 2008

(65) Prior Publication Data

US 2009/0234645 A1 Sep. 17, 2009

(51) Int. Cl.
*G10L 19/14* (2006.01)
*G10L 19/00* (2006.01)

(52) U.S. Cl. ..... 704/211; 704/200.1; 704/205; 704/501

(58) Field of Classification Search ..... None
See application file for complete search history.

(56) References Cited

U.S. PATENT DOCUMENTS 4,417,102 A * 11/1983 Allen ..... 704/227
4,626,827 A * 12/1986 Kitamura et al. ..... 341/110
4,673,916 A * 6/1987 Kitamura et al. ..... 341/110
5,543,792 A * 8/1996 Johnson et al. ..... 341/123
5,657,420 A * 8/1997 Jacobs et al. ..... 704/223
5,717,823 A * 2/1998 Kleijn ..... 704/220
6,208,276 B1 3/2001 Snyder
6,384,759 B2 * 5/2002 Snyder ..... 341/123
6,496,794 B1 * 12/2002 Kleider et al. ..... 704/201
6,531,971 B2 * 3/2003 Kempf ..... 341/63
(Continued)

FOREIGN PATENT DOCUMENTS

EP 09/33889 A1 8/1999

OTHER PUBLICATIONS

Elramly et al., "Continuous Variable Sampling Rate, Application on Speech", 2nd IEEE Symposium on Computers and Communications, pp. 189, Jul. 1997.*
Dieter et al., "Power Reduction by Varying Sampling Rate", ISLPED'05, Aug. 8-10, 2005.*

*Primary Examiner* — Brian Albertalli

(57) ABSTRACT

An audio/speech sender and an audio/speech receiver and methods thereof. The audio/speech sender comprising a core encoder adapted to encode a core frequency band of an input audio/speech signal having a first sampling frequency, wherein the core frequency band comprises frequencies up to a cut-off frequency. The audio/speech sender further comprises a segmentation device adapted to perform a segmentation of the input audio/speech signal into a plurality of segments, a cut-off frequency estimator adapted to estimate a cut-off frequency for each segment and adapted to transmit information about the estimated cut-off frequency to a decoder, a low-pass filter adapted to filter each segment at said estimated cut-off frequency, and a re-sampler adapted to resample the filtered segments with a second sampling frequency that is related to said cut-off frequency in order to generate an audio/speech frame to be encoded by said core encoder.

28 Claims, 7 Drawing Sheets

U.S. PATENT DOCUMENTS

| | | | | |
|---|---|---|---|---|
| 6,915,264 | B2 * | 7/2005 | Baumgarte | 704/500 |
| 7,050,972 | B2 * | 5/2006 | Henn et al. | 704/228 |
| 7,240,001 | B2 * | 7/2007 | Chen et al. | 704/230 |
| 7,444,281 | B2 * | 10/2008 | Sundqvist et al. | 704/201 |
| 7,996,233 | B2 * | 8/2011 | Oshikiri | 704/500 |
| 2005/0091041 | A1 * | 4/2005 | Ramo et al. | 704/205 |
| 2006/0161427 | A1 | 7/2006 | Ojala | |
| 2007/0192086 | A1 * | 8/2007 | Guo et al. | 704/200.1 |
| 2009/0132261 | A1 * | 5/2009 | Kjorling et al. | 704/500 |

* cited by examiner

METHODS AND ARRANGEMENTS FOR A SPEECH/AUDIO SENDER AND RECEIVER

TECHNICAL FIELD

The present invention relates to a speech/audio sender and receiver. In particular, the present invention relates to an improved speech/audio codec providing an improved coding efficiency.

BACKGROUND

Conventional speech/audio coding is performed by a core codec. A codec implies an encoder and a decoder. The core codec is adapted to encode/decode a core band of the signal frequency band, whereby the core band includes the essential frequencies of a signal up to a cut-off frequency, which, for instance, is 3400 Hz in case of narrowband speech. The core codec can be combined with bandwidth extension (BWE), which handles the high frequencies above the core band and beyond the cut-off frequency. BWE refers to a kind of method that increases the frequency spectrum (bandwidth) at the receiver over that of the core bandwidth. The gain with BWE is that it usually can be done with no or very little extra bit rate in addition to the core codec bit rate. The frequency point marking the border between the core band and the high frequencies handled by bandwidth extension is in this specification referred to as the cross-over frequency, or the cut-off frequency.

Overclocking is a method, available e.g. in the Adaptive MultiRate-WideBand+(AMR-WB+)—audio codec in 3GPP TS 26.290 Extended Adaptive Multi-Rate-Wideband (AMR-WB+) codec; Transcoding functions), allowing to operate the codec at a modified internal sampling frequency, even though it was originally designed for a fixed internal sampling frequency of 25.6 kHz. Changing the internal sampling frequency allows for scaling the bit rate, bandwidth and complexity with the overclocking factor, as explained below. This allows for operating the codec in a very flexible manner depending on the requirements on bit rate, bandwidth and complexity. E.g. if very low bit rate is needed, a low overclocking factor (=underclocking) can be used, which at the same time means that the encoded audio bandwidth and complexity is reduced. On the other hand, if very high quality encoding is desired, a high overclocking factor is used allowing to encode a large audio bandwidth at the expense of increased bit rate and complexity.

Overclocking in the encoder side is realized by using a flexible resampler in the encoder frontend, which converts the original audio sampling rate of the input signal (e.g. 44.1 kHz) to an arbitrary internal sampling frequency, which deviates from the nominal internal sampling frequency by an overclocking factor. The actual coding algorithm always operates on a fixed signal frame (containing a pre-defined number of samples) sampled at the internal sampling frequency; hence it is in principle unaware of any overclocking. However, various codec attributes are scaled by a given overclocking factor, such as bit rate, complexity, bandwidth, and cross-over frequency.

It would be desired to use of the above mentioned overclocking method in order to achieve an increased coding efficiency. This would lead to improved signal quality at the same bit rate or lower bit rate while maintaining the same quality level.

The U.S. Pat. No. 7,050,972 describes a method for an audio coding system that adaptively over time adjusts the cross-over frequency between a core codec for coding a lower frequency band and a high frequency regeneration system, also referred to bandwidth extension in this specification, of a higher frequency band. It is further described that the adaptation can be made in response to the capability of the core codec to properly encode the low frequency band.

However U.S. Pat. No. 7,050,972 does not provide means for improving the coding efficiency of the core codec, namely operating it at a lower sampling frequency. The method merely aims for improving the efficiency of the total coding system by adapting the bandwidth to be encoded by the core codec such that it is ensured that the core codec can properly encode its band. Hence, the purpose is achieving an optimum performance trade-off between core and bandwidth extension band rather than making any attempt which would render the core codec more efficient.

Patent application (WO-2005096508) describes another method comprising a band extending module, a re-sampling module and a core codec comprising psychological acoustic analyzing module, time-frequency mapping module, quantizing module, entropy coding module. The band extending module analyzes the original inputted audio signals in whole bandwidth, extracts the spectral envelope of the high-frequency part and the parameters charactering the dependency between the lower and higher parts of the spectrum. The re-sampling module re-samples the inputted audio signals, changes the sampling rate, and outputs them to the core codec.

However, patent application (WO-2005096508) does not contain provisions which would allow for adapting the operation of the re-sampling module in dependence of some analysis of the input signal. Also, no adaptive segmentation means of the original input signal are foreseen, which would allow to map an input segment after an adaptive re-sampling onto an input frame of a subsequent core code, the input frame containing a pre-defined number of samples. The consequence of this is that it cannot be ensured that the core codec operates on the lowest possible signal sampling rate and hence, the efficiency of the overall coding system is not as high as would be desirable.

The publication C. Shahabi et al.: A comparison of different haptic compression techniques; ICME 2002 describes an adaptive sampling system for haptic data operating on data frames, which periodically identifies the Nyquist frequency for the data window and subsequently resamples the data at this frequency. The sampling frequency is for practical reasons chosen according to a cut-off frequency, beyond which the signal energy can be neglected.

The problem with the solution described in the above mentioned publication C. Shahabi et al. is that it provides no gain in the context of speech and audio coding. For sampling of haptic data a criterion related to the relative energy content beyond the cut-off frequency (e.g. 1%) may be appropriate, which aims to retain an accurate representation of the data at a lowest possible sampling rate. However, in the context of speech and audio coding, usually there are fixed constraints on the input or output sampling frequency implying that the original signal is first lowpass filtered with a fixed cut-off frequency and subsequently downsampled to the required sampling rate of e.g. 8, 16, 32, 44.1, or 48 kHz. Hence, the bandwidth of the speech or audio signal is already artificially limited to a fixed cut-off frequency. A subsequent adaptation of the sampling frequency according to the method of this publication would generally not work as it would only lead to a fixed rather than an adaptive sampling frequency as a consequence of the artificially fixed cut-off frequency.

However, even in the case where the bandwidth is artificially limited, depending on the local (in time) perception properties of the audio signal, the impact of the fixed bandwidth limitation is not always perceived the same. For certain parts (segments) of the signal, in which high frequencies are hardly perceivable, e.g. due to masking by dominant low frequency content, a more aggressive low pass filtering and sampling with a correspondingly lower sampling frequency would be possible. Hence, conventional speech and audio coding systems operate on a locally too high sampling frequency than perceptually motivated and thus compromise coding efficiency.

SUMMARY

The object of the present invention is to provide methods and arrangements for improving coding efficiency in a speech/audio codec.

According to the present invention, an increased coding efficiency is achieved by locally (in time) adapting the sampling frequency and making sure that it is not higher than necessary.

According a first aspect, the present invention relates to an audio/speech sender comprising a core encoder adapted to encode a core frequency band of an input audio/speech signal. The core encoder operating on frames of the input audio/speech signal comprising a pre-determined number of samples. The input audio/speech signal having a first sampling frequency, and the core frequency band comprises frequencies up to a cut-off frequency. The audio/speech sender according to the present invention comprises a segmentation device adapted to perform a segmentation of the input audio/speech signal into a plurality of segments, wherein each segment has an adaptive segment length, a cut-off frequency estimator adapted to estimate a cut-off frequency for each segment associated with the adaptive segment length and adapted to transmit information about the estimated cut-off frequency to a decoder, a low-pass filter adapted to filter each segment at said estimated cut-off frequency, and a re-sampler adapted to resample the filtered segments with a second sampling frequency that is related to said cut-off frequency in order to generate an audio/speech frame of the predetermined number of samples to be encoded by said core encoder.

Preferably, the cut-off frequency estimator is adapted to make an analysis of the properties of a given input segment according to a perceptual criterion, to determine the cut-off frequency to be used for the given segment based on the analysis. Moreover, the cut-off frequency estimator may also be adapted to provide a quantized estimate of the cut-off frequency such that it is possible to re-adjust the segmentation based on said cut-off frequency estimate.

According to a second aspect of the present invention an audio/speech receiver adapted to decode received an encoded audio/speech signal is provided. The audio/speech receiver comprises a resampler adapted to resample a decoded audio/speech frame by using information of a cut-off frequency estimate to generate an output speech segment, wherein said information is received from an audio/speech sender comprising a cut-off frequency estimator adapted to generate and transmit said information.

According to a third aspect, the present invention relates to a method in an audio/speech sender. The method comprises the steps segmentation of the input audio/speech signal into a plurality of segments, wherein each segment has an adaptive segment length, estimating a cut-off frequency for each segment associated with the adaptive segment length and adapted to transmit information about the estimated cut-off frequency to a decoder, low-pass filtering each segment at said estimated cut-off frequency, and resampling the filtered segments with a second sampling frequency that is related to said cut-off frequency in order to generate an audio/speech frame of the predetermined number of samples to be encoded by said core encoder.

According to a fourth aspect, the present invention relates to a method in an audio/speech receiver for decoding a received encoded audio/speech signal. The method comprises the step of resampling a decoded audio/speech frame by using information of a cut-off frequency estimate to generate an output audio/speech segment, wherein said information is received from an audio/speech sender comprising a cut-off frequency estimator adapted to generate and transmit said information.

Thus by using the above mentioned methods it is possible to increase the coding efficiency.

According to an embodiment of the invention, further efficiency increase is achieved in conjunction with BWE. This allows keeping the bandwidth and hence bit rate of the core codec at a minimum and at the same time ensuring that the core codec operates with critically (Nyquist) sampled data.

An advantage with the present invention is that in packet switched applications using IP/UDP/RTP, the required transmission of the cut-off frequency is for free as it can be indicated indirectly by using the time stamp fields. This assumes that preferably the packetization is done such that one IP/UDP/RTP packet corresponds to one coded segment.

A further advantage with the present invention is that it can be used for VoIP in conjunction with existing speech codecs, e.g. AMR as core codec, as the transport format (e.g. RFC 3267) is not affected.

DETAILED DESCRIPTION

In the following description, for purposes of explanation and not limitation, specific details are set forth, such as particular sequences of steps, signalling protocols and device configurations in order to provide a thorough understanding of the present invention. It will be apparent to one skilled in the art that the present invention may be practised in other embodiments that depart from these specific details.

Moreover, those skilled in the art will appreciate that the functions explained herein below may be implemented using software functioning in conjunction with a programmed microprocessor or general purpose computer, and/or using an application specific integrated circuit (ASIC). It will also be appreciated that while the current invention is primarily described in the form of methods and devices, the invention may also be embodied in a computer program product as well as a system comprising a computer processor and a memory coupled to the processor, wherein the memory is encoded with one or more programs that may perform the functions disclosed herein.

The basic concept of the invention is to divide a speech/audio signal to be transmitted into segments of a certain length. For each segment, a perceptually oriented cut-off frequency estimator derives the locally (per segment) suitable cut-off frequency fc, which leads to a defined loss of perceptual quality. That implies that the cut-off frequency estimator is adapted to select such a cut-off frequency which makes the signal distortion due to band-limitation such that a person would perceive them as e.g. tolerable, hardly audible, inaudible.

Figure 1:
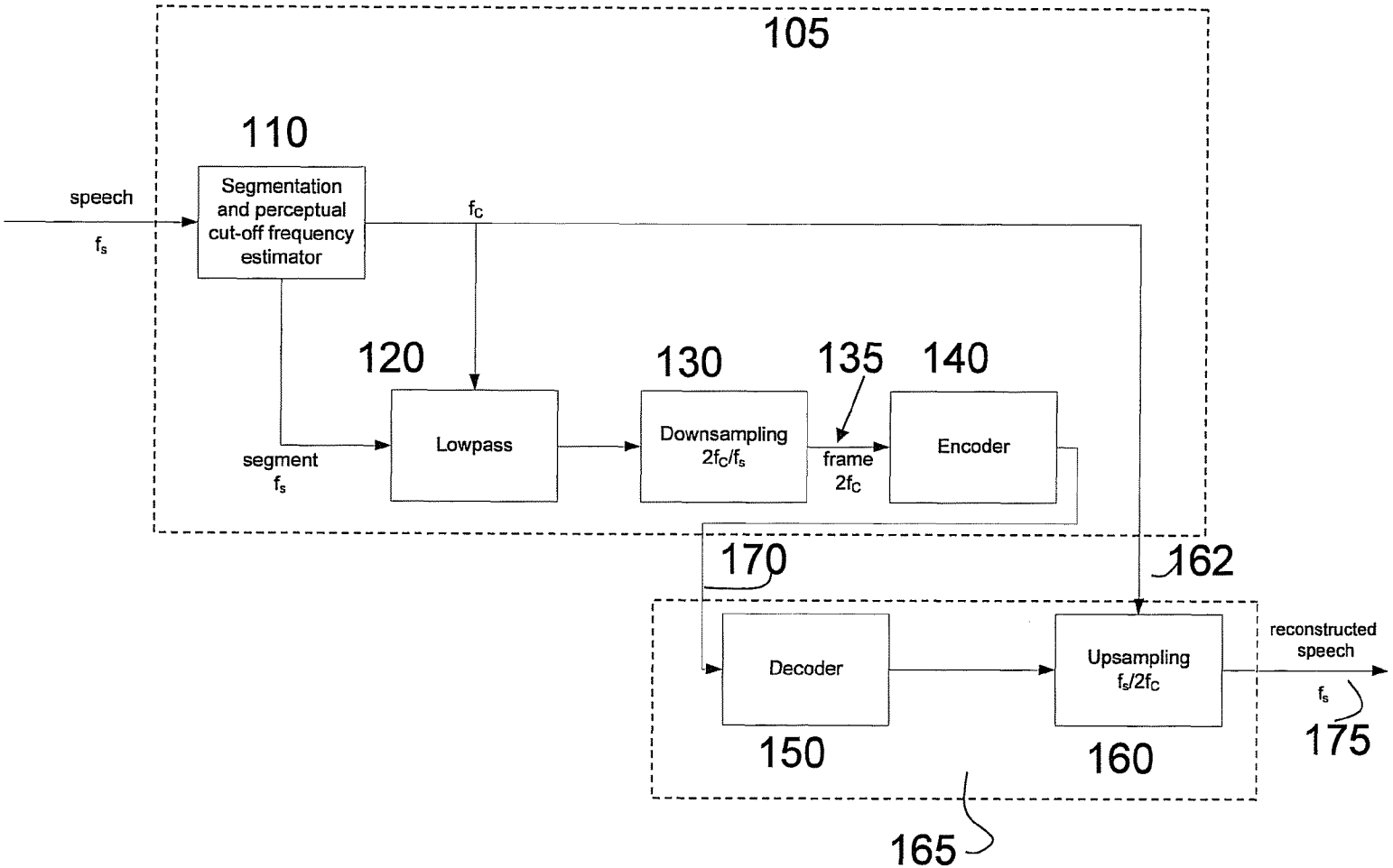
FIG. 1 shows a codec schematically illustrating the basic concept of the present invention.

FIG. 1 illustrates a sender 105 and a receiver 165 according to the present invention. A segmentation device 110 divides the incoming speech signal into segments and a cut-off frequency estimator derives a cut-off frequency for each segment, preferably based on a perceptual criterion. Perceptual criteria aim to mimic human perception and are frequently applied in the coding of speech and audio signal. Coding according to a perceptual criterion means to do the encoding by applying a psychoacoustic model of the hearing. The psychoacoustic model determines a target noise shaping profile according to which the coding noise is shaped such that quantization (or coding) errors are less audible to the human ear. A simple psychoacoustic model is part of many speech encoders which apply a perceptual weighting filter during the determination of the excitation signal of the LPC synthesis filter. Audio codecs usually apply more sophisticated psychoacoustic models which may comprise frequency masking, which, e.g., renders low-power spectral components close to high power spectral components inaudible. Psychoacoustic modelling is well known to persons skilled in the art of speech and audio coding. The segments are then lowpass filtered by a lowpass filter 120 according to the cut-off frequency. A resampler 130 subsequently resamples the segment with a frequency (e.g. 2fc) that is chosen in accordance to the perceptual cut-off frequency, leading to a frame 135. This frequency is transmitted to the receiver 165 either directly or indirectly via the segment length. The segment length in turn corresponds to the timestamp difference between two successive packets, assuming that an IP/UDP/RTP transport protocol or similar is used and that one coded segment per packet is transmitted. It can also be noted that the relation between segment length $l_s$ and $f_c$ is: $l_s=n_f/2f_c$, where $n_f$ equals the frame length in samples. The frame is a vector of input samples to the encoder, on which the encoder operates. The frame is thus encoded by the encoder 140 of an arbitrary speech or audio codec and transmitted over the channel 170. At the receiver 165, the encoded frame is decoded using the decoder 150. The decoded frame is resampled at the resampler 160 to the original sampling frequency leading to a reconstructed segment 175. To that purpose the frequency that has been used for re-sampling (e.g. 2fc) has to be available/known at the receiver 165 as stated above.

According to one embodiment, the used sampling frequency is transmitted directly as a side-information parameter. Typically, in order to limit the bit rate required for that, quantization and coding of this parameter needs to be done.

Hence, the segmentation and cut-off frequency estimator block also comprises a quantization and coding entity for it. One typical embodiment is to use a scalar quantizer and to restrict the number of possible cut-off frequencies to a small number of e.g. 2 or 4, in which case a one- or two-bit coding is possible.

According to alternative embodiments, the used sampling frequency is transmitted by indirect signalling via the segmentation. One way is to signal the chosen (and quantized) segment length. Typically, the cut-off frequency is derived from the segment length via the relation $f_c=n_f/2l_s$, which relates the segment length $l_s$ with the cut-off frequency $f_c$ and the frame length in samples $n_f$. Another indirect possibility is to transmit the used sampling frequency indirectly by using time stamps of the first sample of one IP/UDP/RTP packet and the first sample of the subsequent packet, where it is assumed that the packetization is done with one coded segment per packet. Thus, the cut-off frequency estimator 110 is either further adapted to transmit information about the estimated cut-off frequency to a decoder 150 directly as a side-information parameter or further adapted to transmit information about the estimated cut-off frequency to a decoder 150 indirectly by using time instants of a first sample of current segment and a first sample of a subsequent segment.

Another way of indirect signalling is to use the bit rate associated with each segment for signalling. Assuming a configuration in which a constant bit rate is available for the encoding of each frame, a low bit rate (per time interval) corresponds to a long segment and hence low cut-off frequency and vice-versa. Even another way is to associate the transmission time instants for the encoded segments with their ending time instants or with the start time instants of the respective next segments. For instance each encoded segment is transmitted a pre-defined time after its ending time. Then, provided that the transmission does not introduce too strong delay jitter, the respective segment lengths can be derived based on the arrival times of coded segments at the receiver.

The derivation of a perceptual cut-off frequency and adaptive segmentation of the original input signal is exemplified by the following procedure:

1. Start with some initial segment length $l_0$ which may be a pre-defined value (e.g. 20 ms) or it may be based on the length of the previous segment.
2. Extract a segment with length $l_0$ starting with the first sample following the end of the previous segment and feed it into the perceptual cut-off frequency estimator.
3. The cut-off frequency estimator makes a frequency analysis of the segment, which can be based on e.g. LPC analysis, some frequency domain transform like FFT or by using filter banks.
4. Calculate and apply a perceptual criterion, which gives an indication of the perceptual (audible) impact of a band limitation of the input signal. Preferably, this takes into account the coding noise that will be introduced by the subsequent coding (including a possible BWE). In particular, in case of strong coding noise (e.g. as a consequence of low bit rate), the perceptual impact of a band limitation of the input signal will be lower and hence a stronger band limitation will be more tolerable.
5. Determine the frequency $f_c$ up to which the spectral content needs to be retained in order to satisfy a predefined quality level according to the calculated perceptual criterion.
6. Re-adjust the segment length based on $f_c$ according to the relation between cut-off frequency and segment length, which typically is $l_f=n_f/2f_c$, where $n_f$ is the frame length of the subsequent codec.
7. Termination: the segmentation algorithm terminates and propagates the segment and the identified cut-off frequency to the subsequent processing blocks. Alternatively, the segmentation may be revised if the found segment length $l_f$ deviates more than a predefined distance from the initial segment length $l_0$. In this case, in order to increase the accuracy of the cut-off frequency estimation, the algorithm is re-entered in p 2, with a new initial segment length $l_0=l_f$.

Note: If the cut-off frequency is quantized and coded, then the procedure is preferably restricted to consider only segment lengths which are possible and which are taken from the discrete set of cut-off frequencies which are possible after quantization. Assuming that after quantization a discrete set of P cut-off frequencies $F=\{f_c(i)\}$ i=1 . . . P can be signaled, then steps 1, 6 and 7 have to be modified such that the segment lengths are taken from a discrete set L of segment lengths $\{l(i)\}$ i=1 . . . P. The set L in turn corresponds to the set F via the relation between the segment length and the cut-off frequency.

It is to be noted that internal codec states usually are affected when modifying the sampling frequency on which the codec is operated. These states have hence to be converted from the previously used sampling frequency to the modified sampling frequency. Typically, in the case when the codec has time-domain states, this sample rate conversion of the states can be done by resampling them to the changed sampling frequency.

Figure 2:
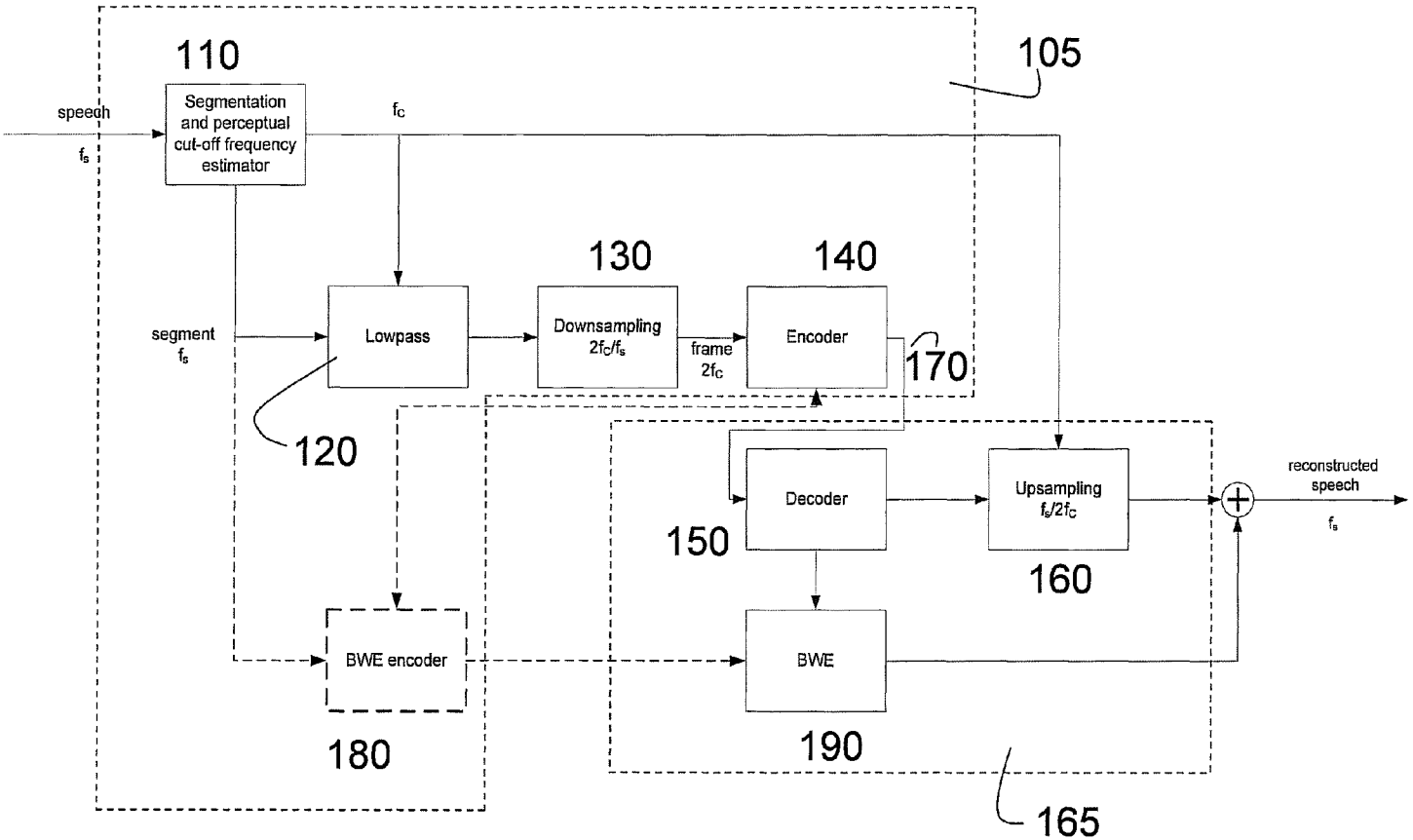
FIG. 2 shows the codec of FIG. 1 with bandwidth extension.

FIG. 2 displays the present invention in combination with a bandwidth extension (BWE) device 190. The use of the bandwidth extension device 190 in association with core decoder 150 allows reducing the perceptual cut-off frequency effective for the core codec by such a degree that a BWE device in the receiver still can properly reconstruct the removed high-frequency content. While the core codec encodes/decodes a low-frequency band up to the cut-off frequency fc, the BWE device 190 contributes with regenerating the upper band ranging from fc to fs/2. A BWE encoder device 180 may also be implemented in association with the core encoder 140 as illustrated in FIG. 2.

In relation and unlike to the method of the U.S. Pat. No. 7,050,972, this embodiment performs an adaptation of the core codec sampling frequency. It hence ensures operating the core codec most efficiently with critically sampled data. Also, in contrast to U.S. Pat. No. 7,050,972, relative to the sampling rate on which the codec operates the invention does not change or adapt the BWE cross-over frequency. While the invention assumes the core encoder operating on the entire frequency band up to the cut-off frequency, U.S. Pat. No. 7,050,972 foresees a core encoder having a variable crossover frequency.

The present invention can be implemented in an open-loop and a closed-loop embodiment.

In the open-loop embodiment the cut-off frequency estimator makes an analysis of the properties of the given input segment according to some perceptual criterion. It determines the cut-off frequency to be used for the given segment based on this analysis and possibly based on some expectation of the performance of the core codec and the BWE. Specifically, this analysis is done in step 4 of the segmentation and cut-off frequency procedure.

Figure 6:
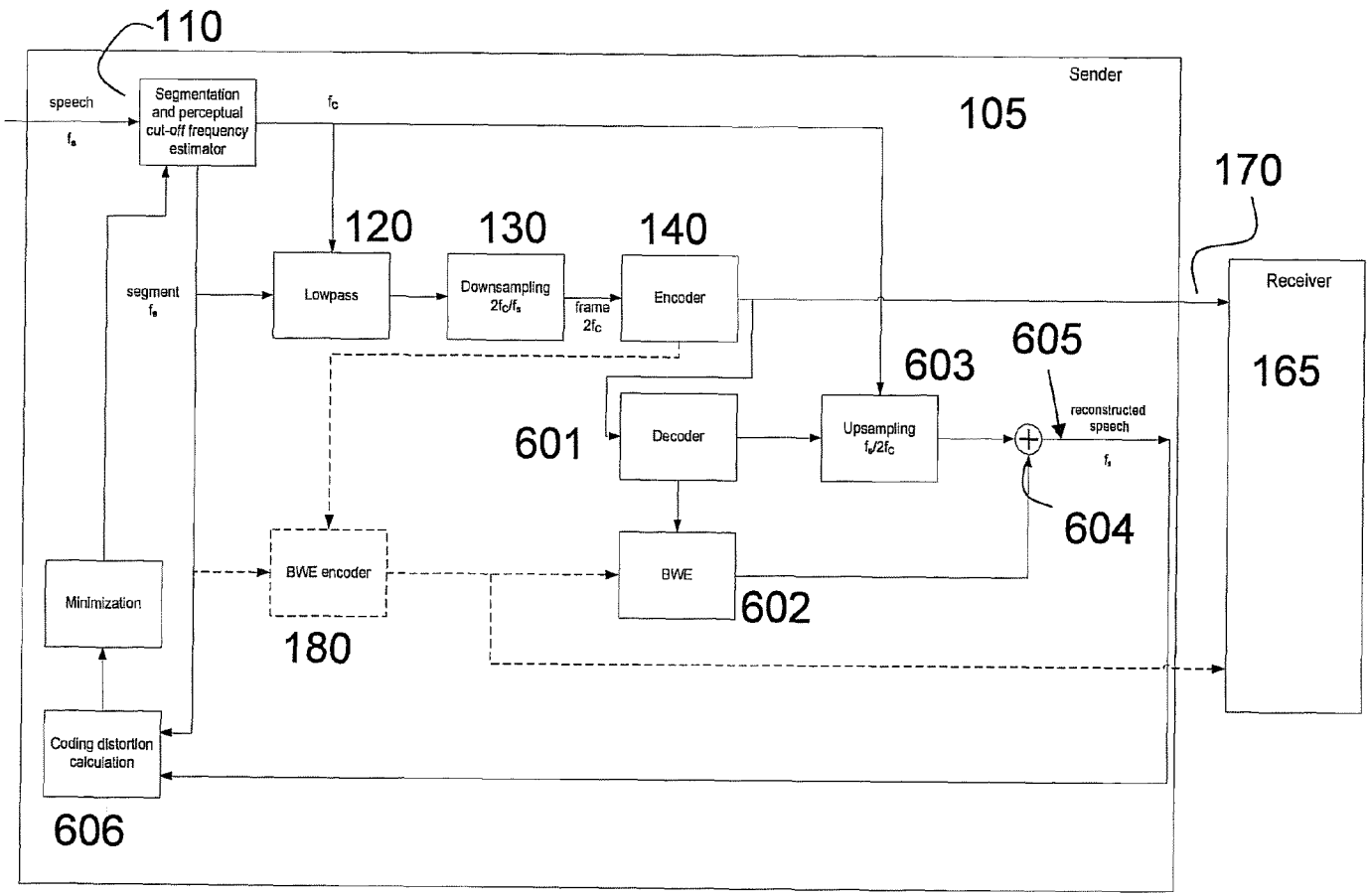
FIG. 6 illustrates the closed-loop embodiment.

In the closed-loop embodiment, shown in FIG. 6, step 4 of the segmentation and cut-off frequency procedure involves a local version of the core decoder 601, BWE 602, upsampler 603 and band combiner (summation point) 604, which performs a complete reconstruction 605 of the received signal that can be generated by the receiver. Subsequently a coding distortion calculator 606 compares the reconstructed signal with the original input speech signal according to some fidelity criterion, which typically again involves a perceptual criterion. If the reconstructed signal is not good enough according to said fidelity criterion, the cut-off frequency estimator 607 is adapted to adjust the cut-off frequency and hence the consumed bit rate per time interval upwards such that the coding distortion determined by a coding distortion calculating unit 606 stays within certain pre-defined limits. If, on the other hand, the signal quality is too good, this is an indication that too much bit rate is spent for the segment. Hence, the segment length can be increased, corresponding to a decreased cut-off frequency and bit rate. It is to be noted that the closed-loop scheme works as well in another embodiment as described above but without any use of BWE.

In a similar embodiment, a primary BWE scheme can be assumed to be part of the core codec. In this case, it may be appropriate to employ a secondary BWE, which again extends the reconstruction band from fc to fs/2 and which corresponds to the BWE 190 block of FIG. 2.

There are some general factors which preferably may influence the segmentation and cut-off frequency selection:

- Source Input Signal
  - The signal class (speech, music, mixed, inactivity) which may be obtained based on some detector decision (e.g. involving a music/voice activity detector) or based on a priori knowledge (derived from meta-data) of the media to be encoded.
  - The noise condition of the input signal obtained from some detector. For instance, in the presence of background noise, the cut-off frequency can be adjusted downwards in order to reduce the amount of this undesired signal component and hence to lift overall quality. Also reducing the cut-off frequency in response of the background noise condition is a measure to reduce the waste of transmission resource (bit rate) for undesirable signal components.
- Target Bit Rate
  - The cut-off frequency may depend on the (possibly) time-varying target bit rate available for coding. Typically, a lower target bit rate will lead to choosing a lower cut-off frequency and vice-versa.
- Feedback from Receiving End
  - The cut-off frequency may depend on knowledge of the properties of the transmission channel and conditions at the receiving end, which typically is obtained via some backward signalling channel. For instance, an indication of a bad transmission channel may lead to lowering the cut-off frequency in order to reduce the spectral signal content which can be affected by transmission errors and hence to improve the perceived quality at the receiver. Also, a reduction of the cut-off frequency may correspond to a reduction of the consumed bit rate, which has a positive effect in case of a congestion condition in the transporting network.
  - Another feedback from the receiving end may comprise information about the receiving end terminal capability and signal playback conditions. An indication of e.g. a low quality signal reconstruction at the receiver may lead to lowering the cut-off frequency in order to avoid the waste of transmission bit rate.

Figure 3:
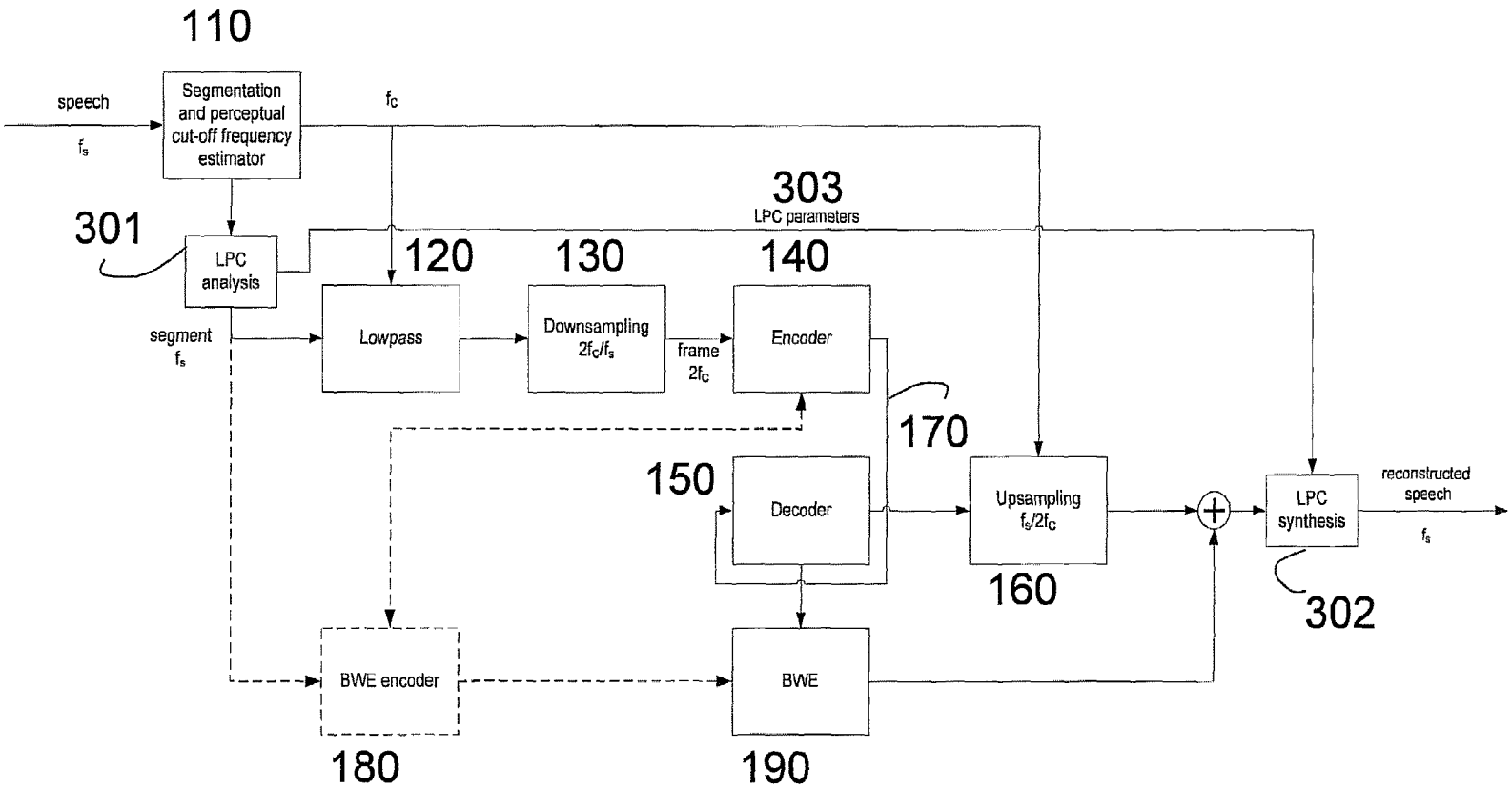
FIG. 3 shows the operation of the present invention with bandwidth extension in the LPC residual domain.

According to a further embodiment the present invention is applied with Linear Predictive Coding (LPC) as illustrated in FIG. 3. FIG. 3 illustrates a sender and a receiver as described in conjunction with FIG. 2. Specifically, a LPC analysis is performed by a LPC device 301 which is an adaptive predictor removing redundancy. The LPC device 301 may either be located prior to the lowpass filtering 120 and after segmentation and cut-off frequency estimation 110 or prior to segmentation and the cut-off frequency estimation 110 leading to the LPC residual which is fed into the resampling device (i.e. the lowpass filter and the downsampler). The LPC residual is the (speech) input filtered by the LPC analysis filter. It is also called the LPC prediction error signal. The receiver generates the final output signal by inverse LPC synthesis filtering the signal obtained by the band combiner (i.e. a summation point). LPC parameters 303 describing the spectral envelope of the segment and possibly a gain factor are transmitted to the receiver for LPC synthesis 302 as additional side information. The benefit with this approach is—since the LPC analysis is done at the original sampling rate $f_s$ and before the resampling—that it provides the receiver with an accurate description of the complete spectral envelope (i.e. including the BWE band of the above embodiment) up to $f_s/2$ rather than only $f_c$ which would be the case if LPC would only be part of the core codec. The described approach with LPC has the positive effect that the BWE may even be as simple as a scheme e.g. merely comprising a simple and low complex white noise generator, spectral folder or frequency shifter (modulator).

Figure 4:
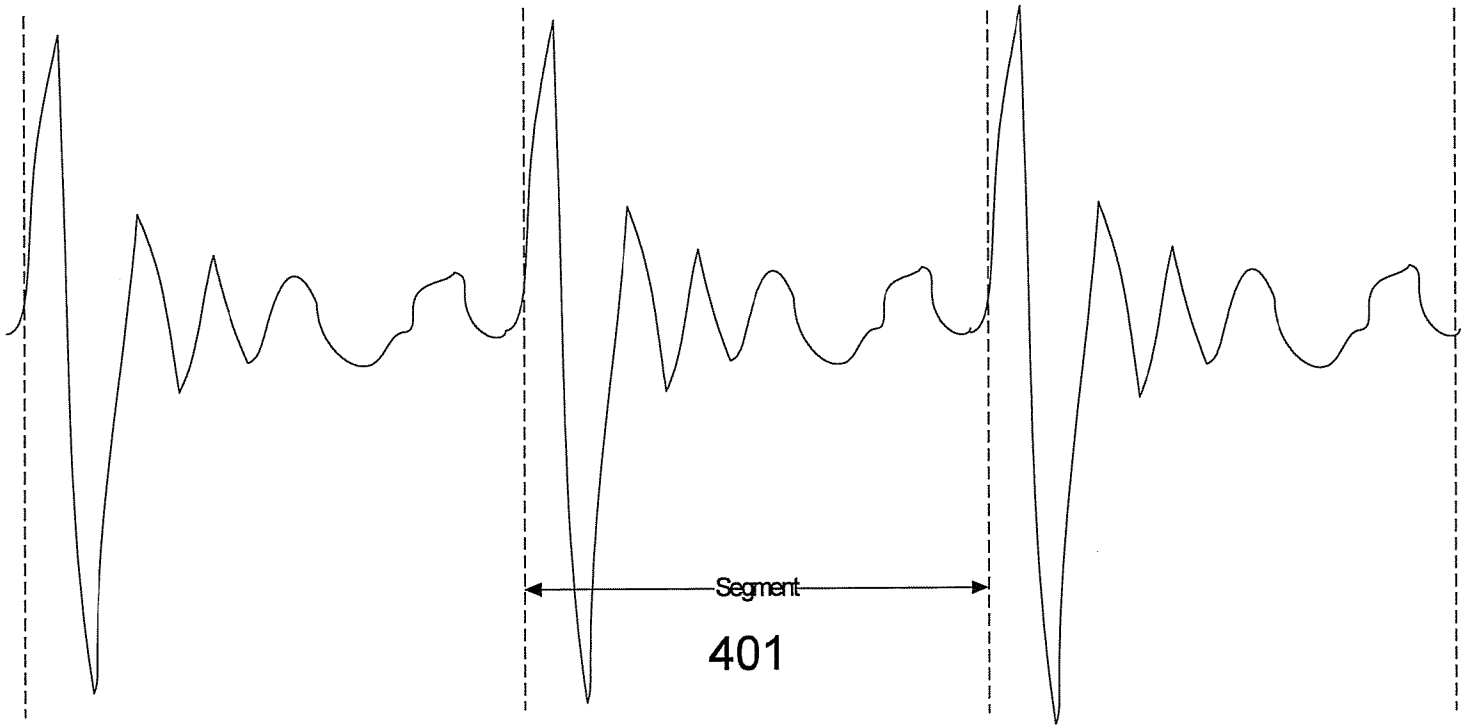
FIG. 4 illustrates pitch-aligned segmentation, which is used in one embodiment of the present invention.

According to a further embodiment, the cut-off frequency and the related signal re-sampling frequency $2f_c$ are selected based on a pitch frequency estimate. This embodiment makes use of the fact that voiced speech is highly periodic with the pitch or fundamental frequency, which has its origin in the periodic glottal excitation during the generation of human voiced speech. The segmentation and hence cut-off frequency is now chosen such that each segment 401 contains one period or an integer multiple of periods of the speech signal in accordance with FIG. 4. More specifically, typically the fundamental frequency of speech is in the range from about 100 to 400 Hz, which corresponds to periods of 10 ms down to 2.5 ms. If the speech signal is not voiced it lacks periodicity with a pitch frequency. In that case segmentation can be done according to a fixed choice of the resampling frequency or, preferably, the segmentation and cut-off frequency selection is done according to any of the embodiments in this document.

A corresponding segmentation allows for pitch synchronous operation which can render the coding algorithm more efficient since the speech periodicity can be exploited more easily and the estimation of various statistical parameters of the speech signal (such as gain or LPC parameters) becomes more consistent.

Figure 5A:
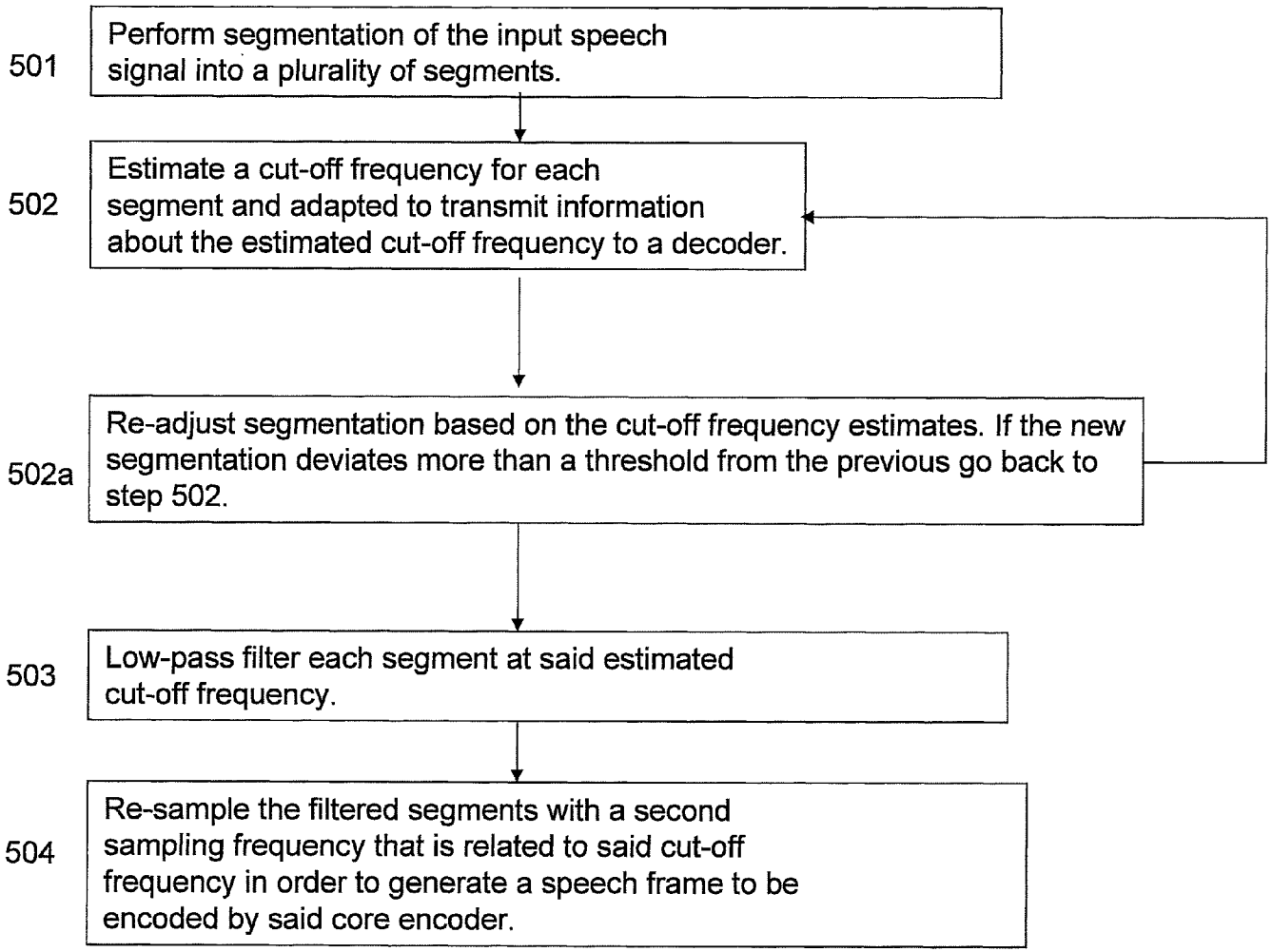
FIG. 5 is a flowchart of the method according to the present invention.

As stated above, the present invention relates to an audio/speech sender and to an audio/speech receiver. Further, the present invention also relates to methods for an audio/speech sender and for an audio/speech receiver. An embodiment of the method in the sender is illustrated in the flowchart of FIG. 5*a* and comprises the steps of:

501. Perform an initial segmentation of the input speech signal into a plurality of segments.

502. Estimate a cut-off frequency for each segment and adapted to transmit information about the estimated cut-off frequency to a decoder.

502*a*. Re-adjust segmentation based on the cut-off frequency estimates. If the new segmentation deviates more than a threshold from the previous go back to step 502.

503. Low-pass filter each segment at said estimated cut-off frequency.

504. Re-sample the filtered segments with a second sampling frequency that is related to said cut-off frequency in order to generate a speech frame to be encoded by said core encoder.

Figure 5B:
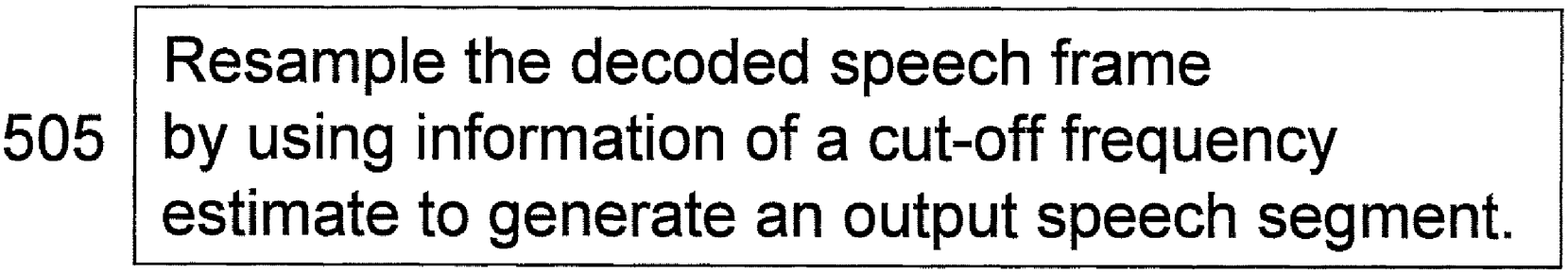

The method in the receiver is illustrated in the flowchart of FIG. 5*b* and comprises the step of:

505. Resample the decoded speech frame by using information of a cut-off frequency estimate to generate an output speech segment, wherein said information is received from an audio/speech sender comprising a cut-off frequency estimator adapted to estimate and transmit said information.

While the present invention has been described with respect to particular embodiments (including certain device arrangements and certain orders of steps within various methods), those skilled in the art will recognize that the present invention is not limited to the specific embodiments described and illustrated herein. Therefore, it is to be understood that this disclosure is only illustrative. Accordingly, it is intended that the invention be limited only by the scope of the claims appended hereto.

The invention claimed is:

1. An audio/speech sender comprising a core encoder adapted to encode a core frequency band of an input audio/speech signal, the core encoder operating on frames of the input audio/speech signal comprising a pre determined number of samples, the input audio/speech signal having a first sampling frequency, and the core frequency band comprises frequencies up to a cut-off frequency, the audio/speech sender comprising:

a segmentation device adapted to perform a segmentation of the input audio/speech signal into a plurality of segments, wherein each segment has an adaptive segment length;

a cut-off frequency estimator adapted to estimate a cut-off frequency for each segment associated with the adaptive segment length and adapted to transmit information about the estimated cut-off frequency to a decoder, wherein the cut-off frequency estimator is further adapted to transmit information about the estimated cut-off frequency to a decoder by indirect signaling via the segmentation;

a low-pass filter adapted to filter each segment at said estimated cut-off frequency; and a re-sampler adapted to resample the filtered segments with a second sampling frequency that is related to said cut-off frequency in order to generate an audio/speech frame of the predetermined number of samples to be encoded by said core encoder.

2. The audio/speech sender according to claim 1, wherein the cut-off frequency estimator is adapted to make an analysis of the properties of a given input segment according to a perceptual criterion, to determine the cut-off frequency to be used for the given segment based on the analysis.

3. The audio/speech sender according to claim 1, wherein the cut-off frequency estimator is further adapted to provide a quantized estimate of the cut-off frequency.

4. The audio/speech sender according to claim 1, wherein the cut-off frequency estimator is further adapted to use the length of each segment for the indirect signalling.

5. The audio/speech sender according to claim 1, wherein the cut-off frequency estimator is further adapted to use the bit rate associated with each segment for the indirect signalling.

6. The audio/speech sender according to claim 1, wherein the cut-off frequency estimator is further adapted to transmit information about the estimated cut-off frequency to a decoder indirectly by using time instants of a first sample of current segment and a first sample of a subsequent segment.

7. The audio/speech sender according to claim 1, wherein the audio/speech sender comprises a linear prediction device located prior to the lowpass filter and after the segmentation device and the cut-off frequency estimator and adapted to produce a LPC residual which is fed into the re-sampler.

8. The audio/speech sender according to claim 1, wherein the audio/speech sender comprises a linear prediction device located prior to the segmentation device and the cut-off frequency estimator and adapted to produce a LPC residual which is fed into the segmentation device.

9. The audio/speech sender according to claim 1, wherein at least one of the cut-off frequency and the second sampling frequency is selected based on a pitch frequency estimate.

10. The audio/speech sender according to claim 1, wherein the audio/speech sender comprises means for generation of a signal which is related to the output signal of the receiver.

11. The audio/speech sender according to claim 10, wherein the audio/speech sender comprises:

a local version of a core decoder;

an upsampler adapted to perform a complete reconstruction of the received signal;

a coding distortion calculator adapted to compare the reconstructed signal with the original input speech signal according to some fidelity criterion, whereby if the reconstructed signal is not good enough according to said fidelity criterion, the cut-off frequency estimator is adapted to adjust the cut-off frequency and consumed bit rate per time interval upwards such that the coding distortion stays within certain pre-defined limits and if the signal quality is too good, the cut-off frequency estimator is adapted to increase the length of the segment corresponding to a decreased cut-off frequency and bit rate.

12. The audio/speech sender according to claim 10, wherein the audio/speech sender further comprises a local version a bandwidth extension device and a band combiner adapted to perform a complete reconstruction of the input audio/speech signal including a high-frequency band reconstructed by BWE.

13. An audio/speech receiver adapted to decode received an encoded audio/speech signal, wherein the audio/speech receiver comprises a resampler adapted to resample a decoded audio/speech frame by using information of a cut-off frequency estimate to generate an output speech segment, wherein said information is received from an audio/speech sender comprising a cut-off frequency estimator adapted to generate and transmit said information, and wherein the audio/speech receiver is further adapted to receive information about the estimated cut-off frequency by indirect siqnalinq via a segmentation of the audio/speech siqnal.

14. The audio/speech receiver according to claim 13, wherein the audio/speech receiver comprises at least one bandwidth extension device adapted to reconstruct the frequencies above the estimated cut-off frequency.

15. The audio/speech receiver according to claim 13, wherein the audio/speech receiver is adapted to receive the chosen and quantized segment length.

16. The audio/speech receiver according to claim 13, wherein the audio/speech receiver is adapted to receive the bit rate associated with each segment for the indirect signalling.

17. The audio/speech receiver according to claim 13, wherein the audio/speech receiver is further adapted to receive information about the estimated cut-off frequency by time instants of a first sample of current segment and a first sample of a subsequent segment.

18. A method in an audio/speech sender comprising a core encoder adapted to encode a core frequency band of an input audio/speech signal, the core encoder operating on frames of the input audio/speech signal comprising a predetermined number of samples, the input speech signal has a first sampling frequency and the core frequency band comprises frequencies up to a cut-off frequency, comprising:

segmentation of the input audio/speech signal into a plurality of segments, wherein each segment has an adaptive segment length, estimating a cut-off frequency for each segment associated with the adaptive segment length and adapted to transmit information about the estimated cut-off frequency to a decoder, low-pass filtering each segment at said estimated cut-off frequency, resampling the filtered segments with a second sampling frequency that is related to said cut-off frequency in order to generate an audio/ speech frame of the predetermined number of samples to be encoded by said core encoder, and transmittinq information about the estimated cut-off frequency to a decoder indirectly via the segmentation.

19. The method according to claim 18, comprising the further step of:

making an analysis of the properties of a given input segment according to a perceptual criterion, to determine the cut-off frequency to be used for the given segment based on the analysis.

20. The method according to claim 18, comprising the further step of:

re-adjusting the segmentation based on cut-off frequency estimates.

21. The method according to claim 18, comprising the further step of:

producing a LPC residual, prior to the lowpass filtering and after the segmentation and the estimation of the cut-off frequency, which is fed into the re-sampler.

22. The method according to claim 18, further comprising the further step of:

producing a LPC residual, prior to the segmentation and the estimation of the cut-off frequency, which is fed into the segmentation step.

23. The method according to claim 18, wherein at least one of the cut-off frequency and the second sampling frequency is selected based on a pitch frequency estimate.

24. The method according to claim 18, comprising the further step of generating a signal which is related to the output signal of a receiver.

25. The method according to claim 24, comprising the further steps of:

performing a complete reconstruction of the received signal;

comparing the reconstructed signal with the original input speech signal according to some fidelity criterion, whereby if the reconstructed signal is not good enough according to said fidelity criterion, adjusting the cut-off frequency and consumed bit rate per time interval upwards such that the coding distortion stays within certain pre-defined limits and if the signal quality is too good, increasing the length of the segment corresponding to a decreased cut-off frequency and bit rate.

26. The method according to claim 24, comprising the further step of performing a complete reconstruction of the input audio/speech signal including a high-frequency band reconstructed by BWE.

27. A method in an audio/speech receiver for decoding a received encoded audio/speech signal, comprising the step of:

resampling a decoded audio/speech frame by using information of a cut off frequency estimate to generate an output audio/speech segment, wherein said information is received from an audio/speech sender comprising a cut-off frequency estimator adapted to generate and transmit said information, wherein the audio/speech receiver is adapted to receive information about the estimated cut-off frequency by indirect signaling via a segmentation of the audio/speech signal.

28. The method according to claim 27, comprising the further step of:

reconstructing the frequencies above the estimated cut-off frequency by at least one bandwidth extension device.

* * * * *